US008401423B2

(12) United States Patent
Suzuki

(10) Patent No.: US 8,401,423 B2
(45) Date of Patent: Mar. 19, 2013

(54) ELECTROPHOTOGRAPHIC IMAGE FORMING APPARATUS

(75) Inventor: Tetsuji Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 503 days.

(21) Appl. No.: 12/568,013

(22) Filed: Sep. 28, 2009

(65) Prior Publication Data

US 2010/0080618 A1 Apr. 1, 2010

(30) Foreign Application Priority Data

Sep. 29, 2008 (JP) ..... 2008-249590
Aug. 21, 2009 (JP) ..... 2009-191927

(51) Int. Cl.
*G03G 15/00* (2006.01)
*G03G 21/18* (2006.01)

(52) U.S. Cl. ..... 399/111; 399/110; 399/107; 399/223

(58) Field of Classification Search ..... 399/107, 399/110, 111, 114, 116, 117, 223, 308
See application file for complete search history.

(56) References Cited

U.S. PATENT DOCUMENTS 6,505,007 B2 1/2003 Miura et al. ..... 399/27
6,681,088 B2 1/2004 Kanno et al. ..... 399/111
7,027,756 B2 4/2006 Hoshi et al. ..... 399/111
7,072,594 B2 7/2006 Hoshi et al. ..... 399/27
7,072,603 B2 7/2006 Tsuzuki et al. ..... 399/111
7,162,174 B2 1/2007 Suzuki et al. ..... 399/64
7,162,181 B2 1/2007 Maeshima et al. ..... 399/109
7,346,293 B2 3/2008 Suzuki et al. ..... 399/111
2007/0059033 A1* 3/2007 Kitozaki ..... 399/110
2007/0077087 A1* 4/2007 Okabe et al. ..... 399/111
2007/0122187 A1* 5/2007 Mase ..... 399/111
2008/0219696 A1* 9/2008 Itabashi ..... 399/114
2009/0297208 A1 12/2009 Suzuki et al. ..... 399/109

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An electrophotographic image forming apparatus for forming an image on a recording material in the state that cartridge is detachably mounted to a main assembly of the electrophotographic image forming apparatus, the electrophotographic image forming apparatus comprising an opening; a cartridge supporting member linearly movable through the opening between an inside position, in the main assembly of the apparatus, for forming an image using the cartridge and an outside position which is outside the main assembly of the apparatus; retracting means for retracting the cartridge supporting member from a region in which the cartridge supporting member faces the opening, in the state that cartridge supporting member is in the outside position; and locking means for releasably locking the cartridge supporting member at the retracted position.

11 Claims, 10 Drawing Sheets

(a)

(b)

ELECTROPHOTOGRAPHIC IMAGE FORMING APPARATUS

FIELD OF THE INVENTION AND RELATED ART

The present invention relates to an electrophotographic image forming apparatus which forms an image on recording medium while the image formation cartridge, or cartridges, therefor remain removably mounted in the main assembly of the image forming apparatus.

There has been proposed a structural arrangement for mounting two or more process cartridges on a cartridge supporting member which is movable relative to the main assembly of an image forming apparatus (U.S. Laid-open Patent Application 2007-77087). This structural arrangement makes it possible to simultaneously insert two or more development cartridges into the main assembly of an image forming apparatus.

Next, an example of image forming apparatus, which is conventional in structure, will be described.

A conventional image forming apparatus is structured so that a development cartridge, that is, a cartridge having a development roller, is removably mountable in the image assembly of the image forming apparatus.

More concretely, a development cartridge is removably mounted in a cartridge tray, which is supported by the main assembly of the image forming apparatus so that it can be moved relative to the main assembly. The cartridge tray is supported by a tray holding member so that it is slidingly movable in the direction intersectional to the lengthwise direction of a photosensitive drum.

After the opening of the cartridge mounting door of the main assembly of the image forming apparatus, the cartridge tray can be pulled out of the main assembly of the image forming apparatus. When the cartridge tray is outside the main assembly while holding the development cartridges, there is nothing on and above the cartridges, making it possible for the cartridges to be removed from the main assembly in the upward direction.

The image forming apparatus described above is provided with a recording medium feeder tray, in which multiple sheets of recording medium are storable in layers, and which can be pulled out of the main assembly. The sheets of recording medium in the recording medium feeder tray are fed into the main assembly by a feed roller, which makes up a part of the recording medium feeding portion of the main assembly. As each sheet of recording medium is conveyed into the interface between each process cartridge and a transfer belt, an image is transferred onto the sheet of recording medium. Then, the sheet of recording medium is discharged from the main assembly by a pair of discharge rollers 22 and 23, which makes up the recording medium discharging portion of the main assembly.

SUMMARY OF THE INVENTION

If an electrophotographic color image forming apparatus which is conventional in structure becomes jammed with a sheet, or sheets, of paper (recording medium), or the like, it is reasonable to think of pulling the jammed paper from the recording medium feeding portion and/or the recording medium discharging portion after pulling the recording medium feeder tray. If it is impossible to remove the jammed paper from the recording medium feeding portion or/and recording medium discharging portion, it is reasonable to think of removing the jammed paper after disengaging the cartridge tray from the main assembly to secure an operational space for removing the jammed paper.

It is also reasonable to think that in order to remove the cartridge tray from the main assembly of the image forming apparatus structured as described above, however, it is necessary to carry out the operation for disengaging the cartridge tray from the main assembly.

Thus, the primary object of the present invention is to improve in usability an electrophotographic image forming apparatus, which employs a cartridge supporting member, by making it unnecessary to remove the cartridge supporting member in order to secure an operational space for such an operation as removing jammed paper or the like.

According to an aspect of the present invention, there is provided An electrophotographic image forming apparatus for forming an image on a recording material in the state that cartridge is detachably mounted to a main assembly of said electrophotographic image forming apparatus, said electrophotographic image forming apparatus comprising an opening; a cartridge supporting member linearly movable through said opening between an inside position, in said main assembly of the apparatus, for forming an image using said cartridge and an outside position which is outside said main assembly of the apparatus; retracting means for retracting said cartridge supporting member from a region in which said cartridge supporting member faces said opening, in the state that cartridge supporting member is in the outside position; and locking means for releasably locking said cartridge supporting member at the retracted position.

As described above, the present invention makes it possible to move the cartridge supporting member of an electrophotographic image forming apparatus away from the area, in which the cartridge supporting member squarely faces the cartridge mounting opening of the apparatus, after moving the cartridge supporting member from its inward position (image forming position) to its outward position. Thus, the present invention can create the operational space for taking care of paper jam or the like without disengaging the cartridge supporting member from the main assembly of the image forming apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereafter, the present invention will be described in detail with reference to some of the preferred embodiments of the present invention. However, the measurement, materials, shapes, and relative positioning of the structural components in these embodiment are to be modified based on the structure of the image forming apparatus to which the present invention is applied, and/or the conditions under which the image forming apparatus is operated. That is, the preferred embodiments of the present invention, which will be referred to in the following detailed description of the present invention, are not intended to limit the present invention is scope.

Embodiment 1

First, referring to FIGS. 1-7, the first preferred embodiment of the electrophotographic image forming apparatus in accordance with the present invention will be described. This embodiment of the electrophotographic image forming apparatus is in the form of a full-color laser beam printer. Hereafter, the overall structure and functions of this laser beam printer will be described. Incidentally, not only is the present invention applicable to a full-color image forming apparatus, but also, a monochromatic laser printer, that is, a laser printer having only one photosensitive member. Further, not only is the present invention applicable to printers, but also, other electrophotographic image forming apparatuses, such as a copying machine, a facsimile machine, etc.

[Description of General Structure of Image Forming Apparatus]

Figure 1:
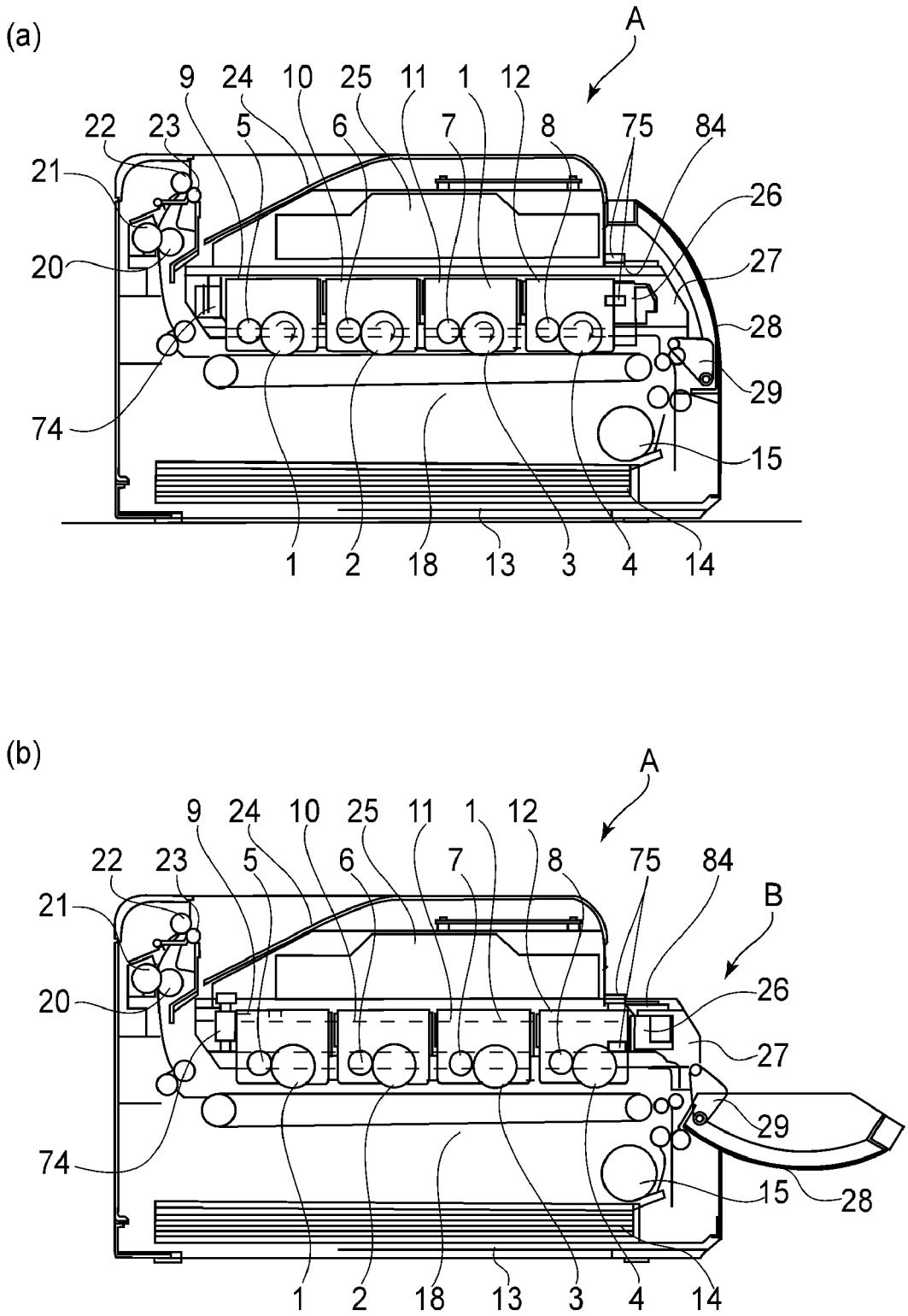
FIGS. 1(*a*) and 1(*b*) are sectional views of the image forming apparatus in the first preferred embodiment of the present invention.

First, referring to FIG. 1(*a*), this embodiment of electrophotographic image forming apparatus in accordance with the present invention will be described in general structure. FIG. 1(*a*) is a sectional view of the first embodiment of the electrophotographic image forming apparatus in accordance with the present invention, and shows the general structure of the apparatus.

This electrophotographic image forming apparatus has: a sheet feeder tray 13 in which multiple sheets of recording medium 14 (paper) are stored in layers; a feeding-and-conveying roller 15, which makes up a recording medium feeding-and-conveying portion of the apparatus; a transfer belt 18; a fixation film 20 and a pressure roller 21, which make up a fixing apparatus; a laser scanner; etc. These components are in the shell of the main assembly A of the image forming apparatus (which hereafter may be referred to simply as main assembly A). The main assembly A is provided with a cartridge tray 26, which is a cartridge supporting member and is removably supported by the main assembly A. The cartridge tray 26 removably supports process cartridges 9, 10, 11, and 12. Each of the process cartridges 9, 10, 11, and 12 has an electrophotographic photosensitive drum (1, 2, 3, and 4, respectively), a development roller (5, 6, 7, and 8, respectively, etc. The development roller is a processing means, which is for processing the photosensitive drum. Each of the process cartridges 9, 10, 11, and 12 is removably supported by the abovementioned cartridge tray 26 so that as the cartridge tray 26 is moved into the preset position in the main assembly A, each process cartridge is precisely placed in its preset position (image formation position) in the main assembly A. Incidentally, in the case of this image forming apparatus, the process cartridges 9, 10, 11, and 12 contain yellow, magenta, cyan, and black developers, respectively. The cartridge tray 26 is structured so that the process cartridges 9, 10, 11, and 12 are held in parallel by the cartridge tray 26. The electrophotographic image forming apparatus is a color image forming apparatus capable of forming a full-color image on recording medium.

The sheets of recording paper 14, which are stored in layers in the feeder tray 13, are fed out of the feeder tray 13 by the feed roller 15, which is being rotated in the counterclockwise direction in the drawing, into the main assembly A, and then, is sent to the transfer belt 18.

The photosensitive drums 1, 2, 3, and 4 are being rotated in the clockwise direction in the drawing. As they are rotated, an electrostatic latent image is sequentially formed on each of the photosensitive drums 1, 2, 3, and 4, across their peripheral surfaces, by beams of laser light from the laser scanner 25. Then, the electrostatic latent images are developed by the development rollers 5, 6, 7, and 8, into images formed of toner (which hereafter will be referred to simply as toner images).

The toner images are transferred onto the sheet of recording paper 14. After the transfer of the toner images onto the recording paper 14, the recording paper 14 is sent to the nip between the fixation film 20 and pressure roller 21, and is conveyed through the nip. While the recording paper 14 is conveyed through the nip, the recording paper 14 and the toner images thereon are subjected to heat and pressure. As a result, the toner images become fixed to the recording paper 14.

After the fixation of the toner images to the recording paper 14, the recording paper 14 is discharged into a delivery tray 24 by a pair of discharge rollers 22 and 23, which make up the recording paper discharging portion of the main assembly A.

[General Description of Process Cartridge Replacement Method]

FIGS. 1(*b*), 2(*a*), and 2(*b*) are sectional views of the first preferred embodiment of the electrophotographic image forming apparatus in accordance with the present invention, which is for describing the method for replacing the process cartridges in the cartridge tray 26. Next, the method for replacing the process cartridge in this image forming apparatus will be described.

The cartridge tray 26 is held to the main assembly A of the image forming apparatus by a tray supporting member 27, so that it can be slidably moved in a straight line in the horizontal direction in FIG. 1(*b*). The cartridge tray 26 removably supports the process cartridges 9, 10, 11, and 12. It is enabled to linearly move between its inward position I, that is, its preset position in the main assembly A, and its outward position O, that is, its preset position outside the main assembly A, through the opening B. That is, the cartridge tray 26 is enabled to take the abovementioned inward position I and outward position O by being moved in the direction perpendicular to the lengthwise direction of the process cartridges which are held in parallel by the cartridge tray 26. More specifically, referring to FIG. 1, the inward position I is a position in the main assembly A, and is the position in which the cartridge tray 26 places the process cartridges 9, 10, 11, and 12 in their image forming positions. Next, referring to FIG. 2, the outward position O is the position outside the main assembly A. Further, the cartridge tray 26 has intermediary electrical contacts, which make electrical contact with the electrical contacts of the process cartridges. The intermediary electrical contacts are enabled to make electrical contact with the electrical contacts, with which the main assembly A is provided.

The above-described electrical contacts and the like are on the lengthwise end of the cartridge tray 26, from which the process cartridges in the tray are not driven. The position of the electrical contacts does not need to be limited to the lengthwise end of the cartridge tray 26, from which the process cartridges in the tray are not driven. That is, they may be placed on the lengthwise end of the cartridge tray 26, from which the process cartridge in the tray are driven. Incidentally, FIG. 3(*a*) shows the cartridge tray 26 and one of the process cartridges, as seen from the side from which the cartridge is driven, whereas FIG. 3(*b*) shows the cartridge tray 26 and one of the process cartridges, as seen from the side from which the cartridge is not driven, that is, the side where the electrical contacts and the like are present.

A door 28 is attached to the main assembly A of the image forming apparatus, and is rotationally movable relative to the main assembly A. It is the member that is to be opened or closed to expose or cover, respectively, the opening B of the main assembly A to carry out such operations as removing jammed paper or the like, or replacing the process cartridge(s). FIG. 1(*b*) shows the image forming apparatus when the door 28 of the apparatus is open (door 28 is in its open position). The door 28 is indirectly attached to the tray supporting member 27 by the door linkage 29, so that the door 28 can be rotationally moved relative to the tray supporting member 27. As the door 28 is opened, the door linkage 29 pulls the tray supporting member 27 out of the main assembly A, and moves the tray supporting member 27 into the tray supporting position, shown in FIG. 1(*b*), which is right- and upward of the tray supporting member position, which is shown in FIG. 1(*a*). The movement of this tray supporting member 27 causes the cartridge tray 26 to move upward, whereby the photosensitive drums 1, 2, 3, and 4 are separated from the transfer belt 18. As a result, it becomes possible for the cartridge tray 26 to be pulled out of the main assembly A.

Figure 2:
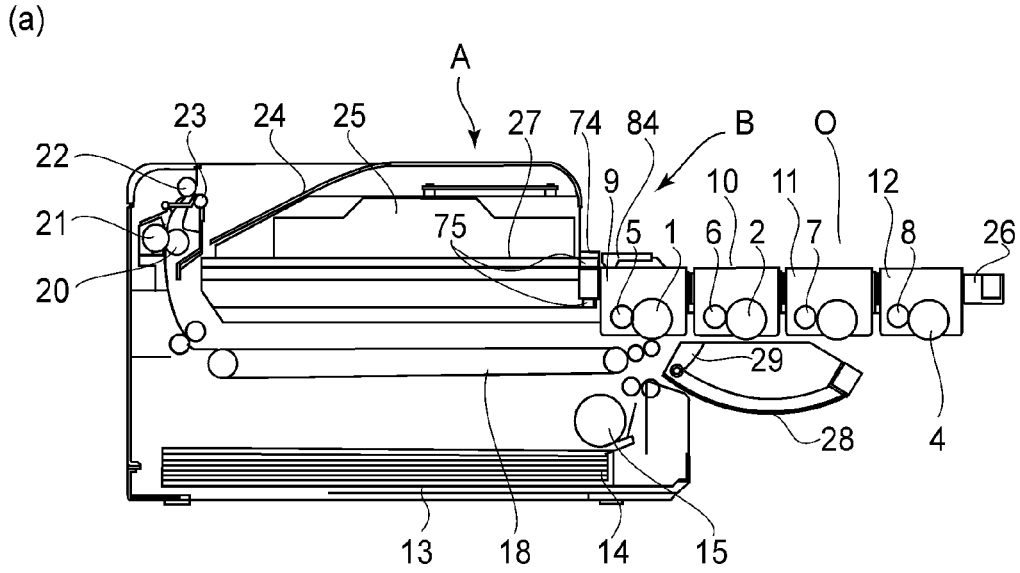
FIGS. 2(*a*) and 2(*b*) are sectional views of the image forming apparatus in the first preferred embodiment of the present invention.
Figure 2:
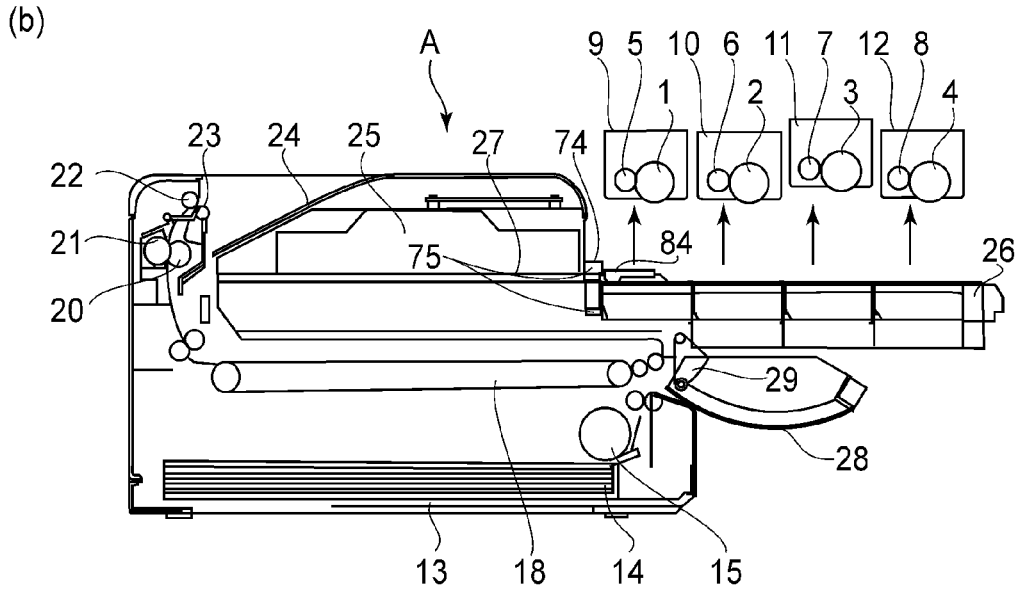
Figure 3:
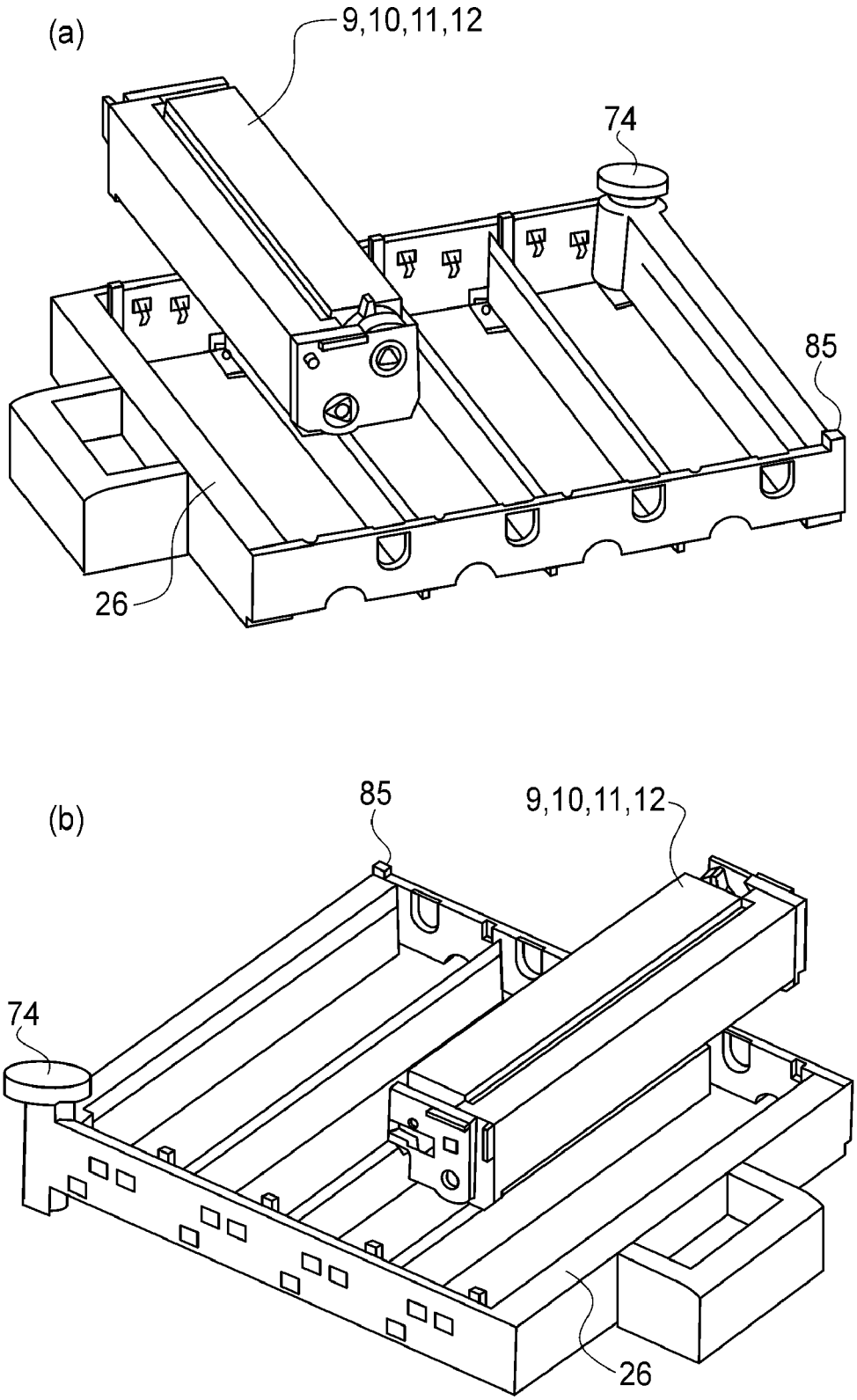
FIGS. 3(*a*) and 3(*b*) are perspective views of the cartridge tray in the first preferred embodiment.
Figure 6:
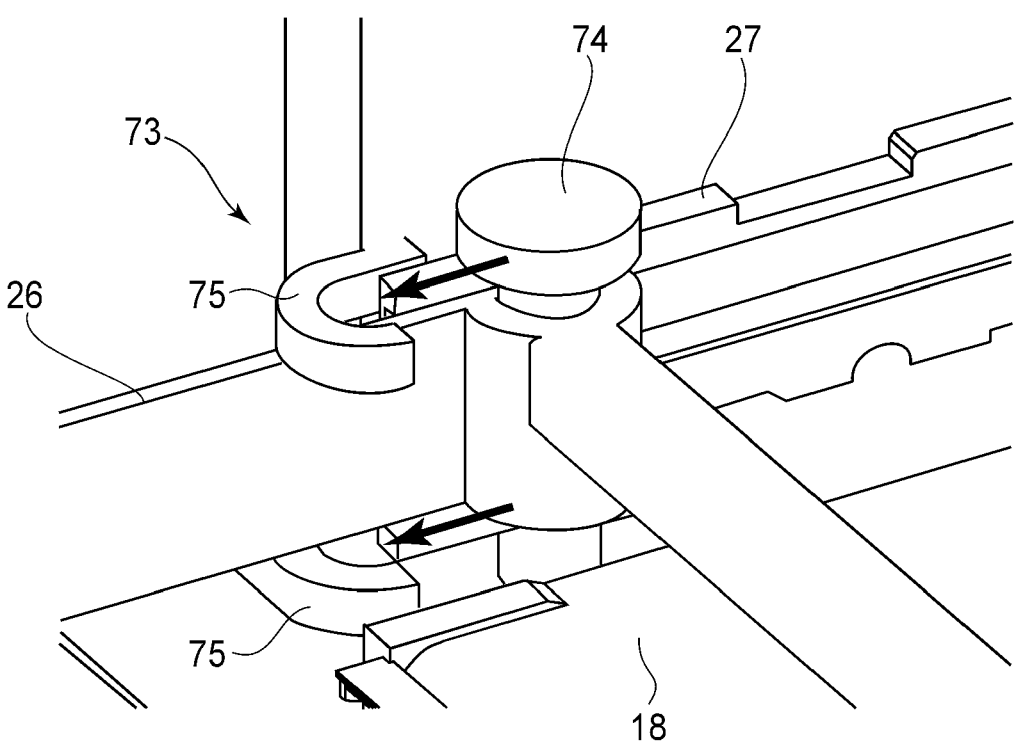
FIG. 6(*a*) is a perspective view of the cartridge tray guiding member in the first preferred embodiment of the present invention, which is for describing the structure of the cartridge tray guiding member, and FIG. 6(*b*) is a sectional view of the essential portions of the cartridge tray stopper portion of the main assembly in the first preferred embodiment of the present invention.
Figure 6:
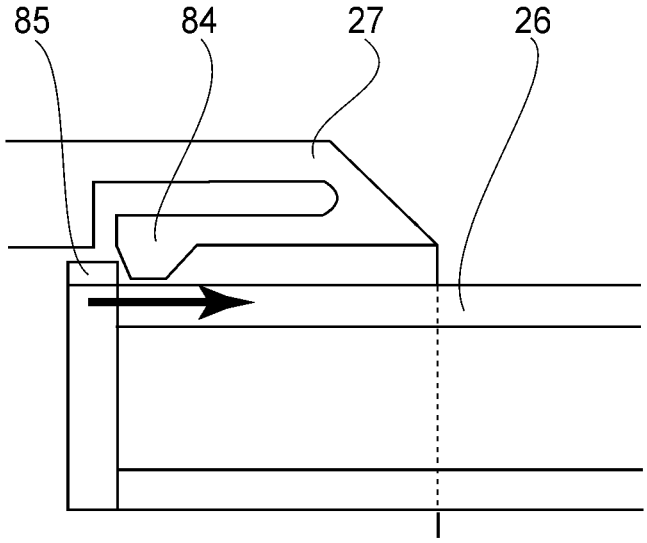
Figure 7:
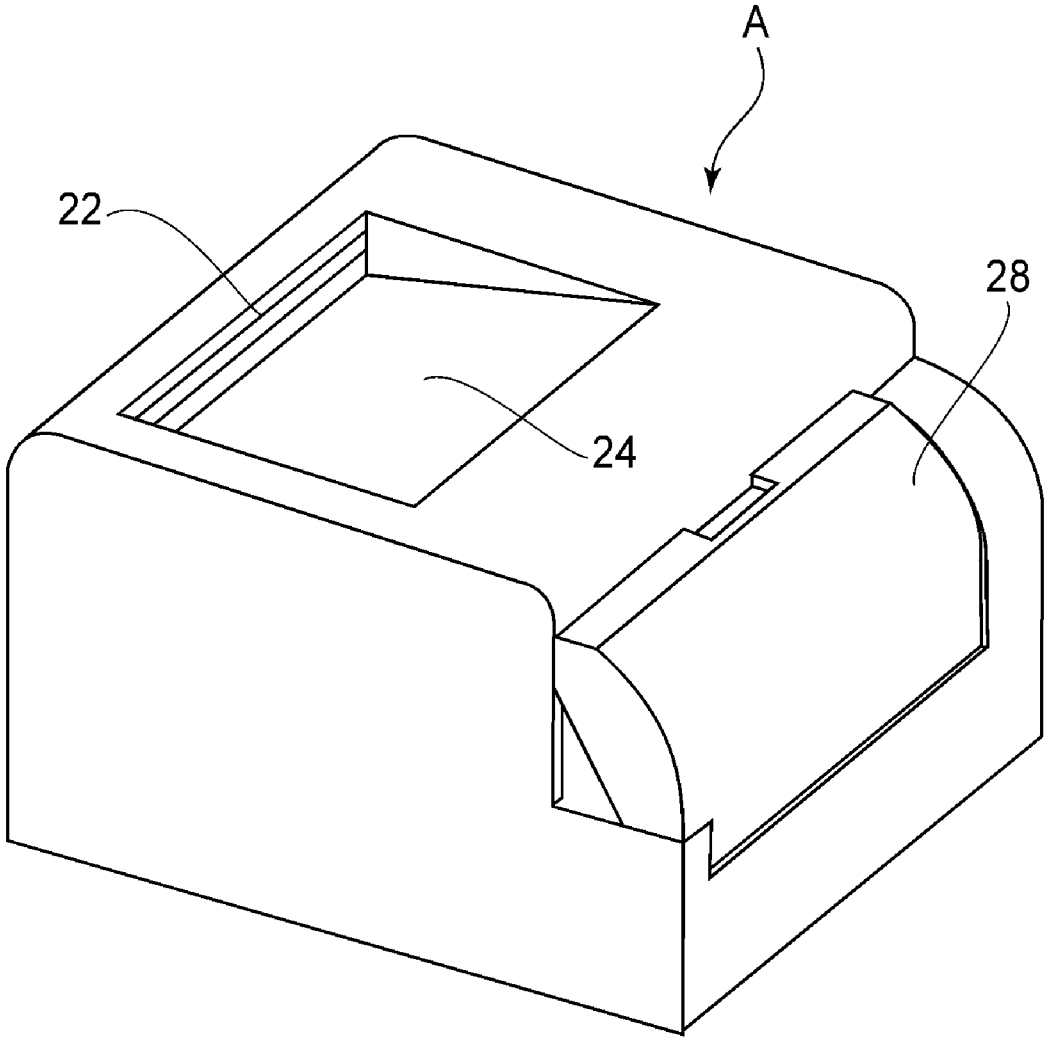
FIG. 7 is a perspective view of the image forming apparatus in the first preferred embodiment.

FIG. 2(*a*) is a sectional view of the image forming apparatus, the cartridge tray 26 of which is in its outward position O of the main assembly A, into which the cartridge tray 26 was pulled out from the inside of the main assembly A, which was exposed by the opening of the door 28. When the cartridge tray 26 is in the position shown in FIG. 2(*a*), the process cartridges 9, 10, 11, and 12 in the cartridge tray 26 are exposed upward, being enabled to be removed from the cartridge tray 26 as shown in FIG. 2(*b*). When the cartridge tray 26 is in the position shown in FIG. 2(*b*), a stopper claw 84, which the main assembly A has, is in engagement with (temporarily locked with) a stopper boss 85 (FIG. 6(*b*)), which the cartridge tray 26 has, preventing thereby the cartridge tray 26 from being pulled out further. Referring to FIG. 6(*b*), the stopper claw 84, which temporarily locks the cartridge tray 26 in place, has a surface which is tilted in the direction in which the cartridge tray 26 is pulled out of the main assembly A. Therefore, the cartridge tray 26 can be easily unlocked in position by a cartridge tray rotating operation, which will be described later.

Figure 4:
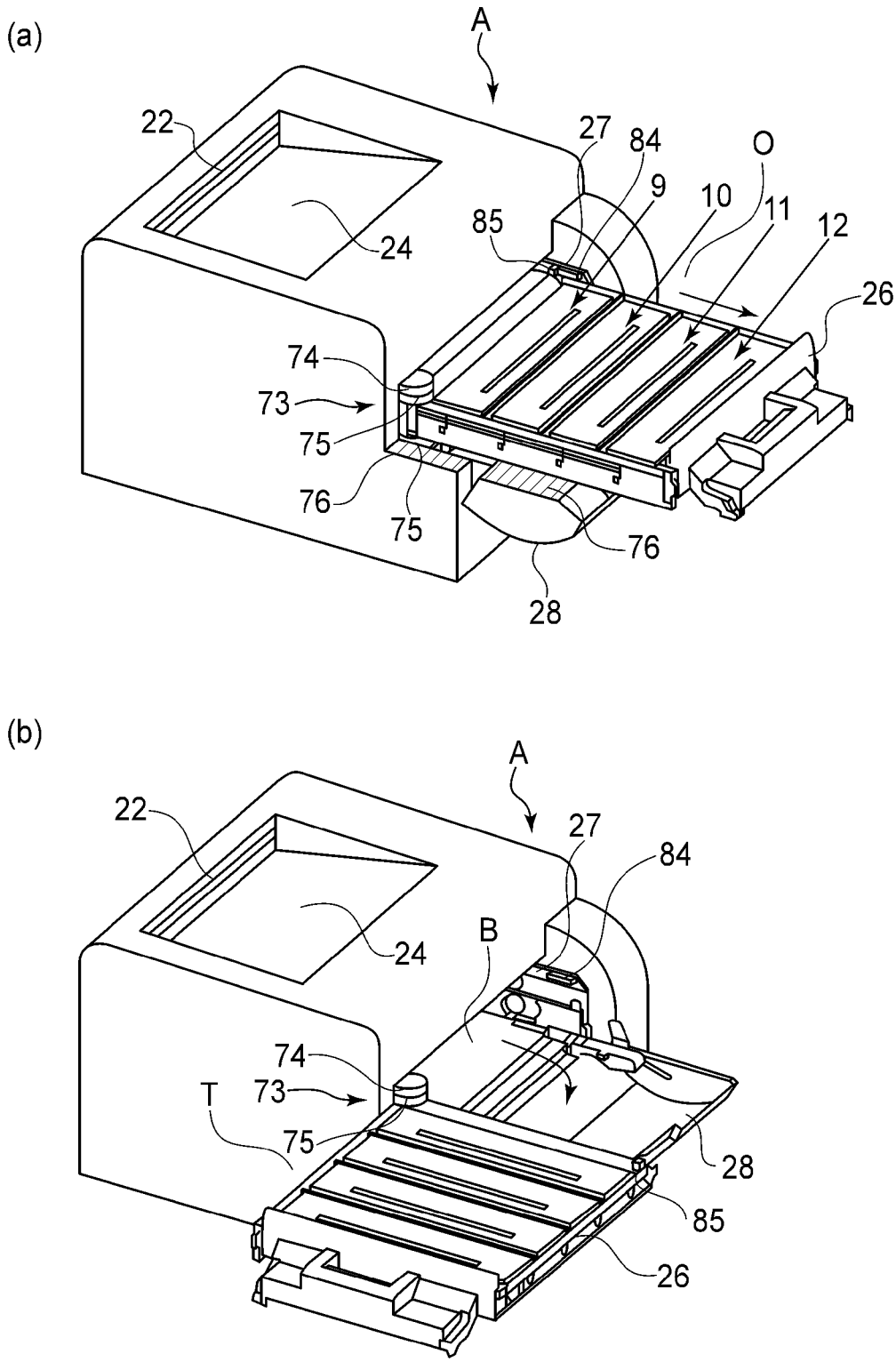
FIGS. 4(*a*) and 4(*b*) are perspective views of the image forming apparatus in the first preferred embodiment.

Next, referring to FIG. 4(*a*), the main assembly A is provided with a means for temporarily displacing the cartridge tray, which is made up of a rotational shaft 74, with which the cartridge tray 26 is provided, and a cartridge tray engaging portion 75, with which the main assembly A is provided. The cartridge tray displacing means will be described later. As the cartridge tray 26 is pulled out of the main assembly A and moved into its outward position O, the rotational shaft 74 of the cartridge tray 26 engages with the cartridge tray engaging portion 75 of the main assembly A. As a result, it becomes possible for the cartridge tray 26 to be rotationally moved about the rotational shaft 74 to be displaced leftward of the opening B. The method for rotationally moving the cartridge tray 26 will be described later in detail. Incidentally, the opening B is the opening with which the main assembly A is provided to store the cartridge tray 26 in the main assembly A.

The operation for mounting the process cartridges 9, 10, 11, and 12 into the main assembly A is opposite in procedure from the operation for removing the process cartridges from the main assembly A. That is, first, the cartridge tray 26 is to be pulled out of the main assembly A, and moved into its outward position O (FIG. 2(*b*)). Then, the process cartridges 9, 10, 11, and 12 are to be placed on the cartridge tray 26 while the cartridge tray 26 is in its outward position O. Then, the cartridge tray 26 is to be put back into the main assembly A. Then, the door 28 is to be closed. As the door 28 is closed, the closing movement of the door 28 causes the door linkage 29 to push the tray supporting member 27 diagonally left- and downward, causing thereby the cartridge tray 26 to move left- and downward. As a result, the process cartridges 9, 10, 11, and 12 held by the cartridge tray 26 are moved into their preset positions (image forming positions), in which the photosensitive drums 1, 2, 3, and 4 remain in contact with the transfer belt 18.

FIG. 4(*a*) is a perspective views of the main assembly A of the image forming apparatus, the door 28 of which is open, and the cartridge tray 26 of which is in its preset outward position O. FIG. 4(*a*) shows the same condition of the image forming apparatus as that in FIG. 2(*b*). When the image forming apparatus is in this condition, the process cartridges 9, 10, 11, and 12 can be pulled out of, or mounted into the cartridge tray 26, and the cartridge tray 26 is rotationally movable.

[General Description of Cartridge Tray Rotating Method]

Next, referring to FIGS. 3-7, the method for rotationally moving the cartridge tray 26 will be described.

Referring to FIG. 6(*a*), this embodiment of image forming apparatus in accordance with the present invention has a guiding member 73, which is a means for displacing the cartridge tray 26 into a displacement position T (FIG. 4(*b*)) from the area in which the cartridge tray 26 squarely faces the opening B of the main assembly A, after the cartridge tray 26 is moved into its outward position O (FIG. 4(*a*)).

The guiding member 73 is a member for guiding the cartridge tray 26 leftward or rightward of the abovementioned opening B, relative to the direction in which the cartridge tray 26 is moved out of, or into, the main assembly A, while keeping the cartridge tray 26 horizontal, after the cartridge tray 26 is moved out of the main assembly A and into its preset outward position O. Incidentally, FIG. 4(*b*) shows the image forming apparatus structured so that the cartridge tray 26 is displaced leftward (side from which cartridges are not driven; side where electrical contacts are present) of the opening B.

Next, referring to FIG. 6(*a*), the guiding member 73 has the abovementioned rotational shaft 74 and a shaft engaging portion 75. The rotational axle 74 functions as the rotational axis of the cartridge tray 26, and the shaft engaging portion 75 engages with the rotational shaft 74. Next, referring to FIGS. 3(*a*) and 3(*b*), the rotational shaft 74 is provided on the same side of the cartridge tray 26 as the side from which the cartridges are not driven. The rotational shaft 74 is in a position in which the rotational shaft 74 does not interfere with the main assembly A, etc., when the cartridge tray 26 is rotationally moved. Next, referring to FIGS. 4(*a*) and 4(*b*), the shaft engaging portion 75 is attached to the main assembly A, on the side from which the cartridges are not driven.

Referring to FIG. 4(*a*), as the cartridge tray 26 is pulled out of the main assembly A from its inward position I in the main assembly A through the opening B, and moved into its outward position O, the cartridge tray 26 is temporarily locked in the outward position O by the above described stopper claw 84 and stopper boss 85.

Further, as the cartridge tray 26 is moved into the outward position O, the rotational shaft 74 of the cartridge tray 26 engages with the shaft engaging portion 75 of the main assembly A, whereby the cartridge tray 26 becomes rotatably supported by the main assembly A. The rotational shaft 74 and shaft engaging portion 75 are shaped so that they mesh with each other, as shown in FIG. 6(*a*).

If it is wanted to rotationally move the cartridge tray 26 leftward of the opening B (leftward of main assembly A), the cartridge tray 26 is to be pulled out of the main assembly A, and moved into its outward position O shown in FIG. 4(*a*). Then, the cartridge tray 26 is to be rotationally moved about the rotational shaft 74 so that the cartridge tray 26 is displaced leftward of the opening B. This operation causes the stopper claw 84 to be pushed up by the stopper boss 85, causing thereby the cartridge tray 26 unlocked from the outward position O. Thus, it becomes possible for the cartridge tray 26 to be rotationally moved.

Referring also to FIG. 4(*a*), the main assembly A and door 28 are provided with tray bearing surfaces 76, which bear the weight of the cartridge tray 26. The tray bearing surfaces 76 function as a means for preventing the cartridge tray 26 from tilting downward after being displaced from the area in which it squarely faces the opening B. That is, not only does the door 28 have the function of keeping the opening B covered, but also, the above described function of preventing the cartridge tray 26 from tilting downward. Thus, as the cartridge tray 26 is rotationally moved, the weight of the cartridge tray 26, or the combined weight of the cartridge tray 26 and process cartridges, is borne by the tray bearing surfaces 76, whereby the combined weight is prevented from concentrating upon the rotational shaft 74 and shaft engaging portion 75.

Next, referring to FIG. 4(*b*), the rotational movement of the cartridge tray 26 is regulated by the contact between the cartridge tray 26, and the adjacency of the opening B of the main assembly A. Further, the cartridge tray 26 is provided with a tray locking member 92, which is for temporarily locking the cartridge tray 26 in the displacement position. Thus, as the cartridge tray 26 is rotationally moved into its displacement position, the tray locking member 92 temporarily engages with the main assembly A, through an engagement process, which will be described later.

Figure 5:
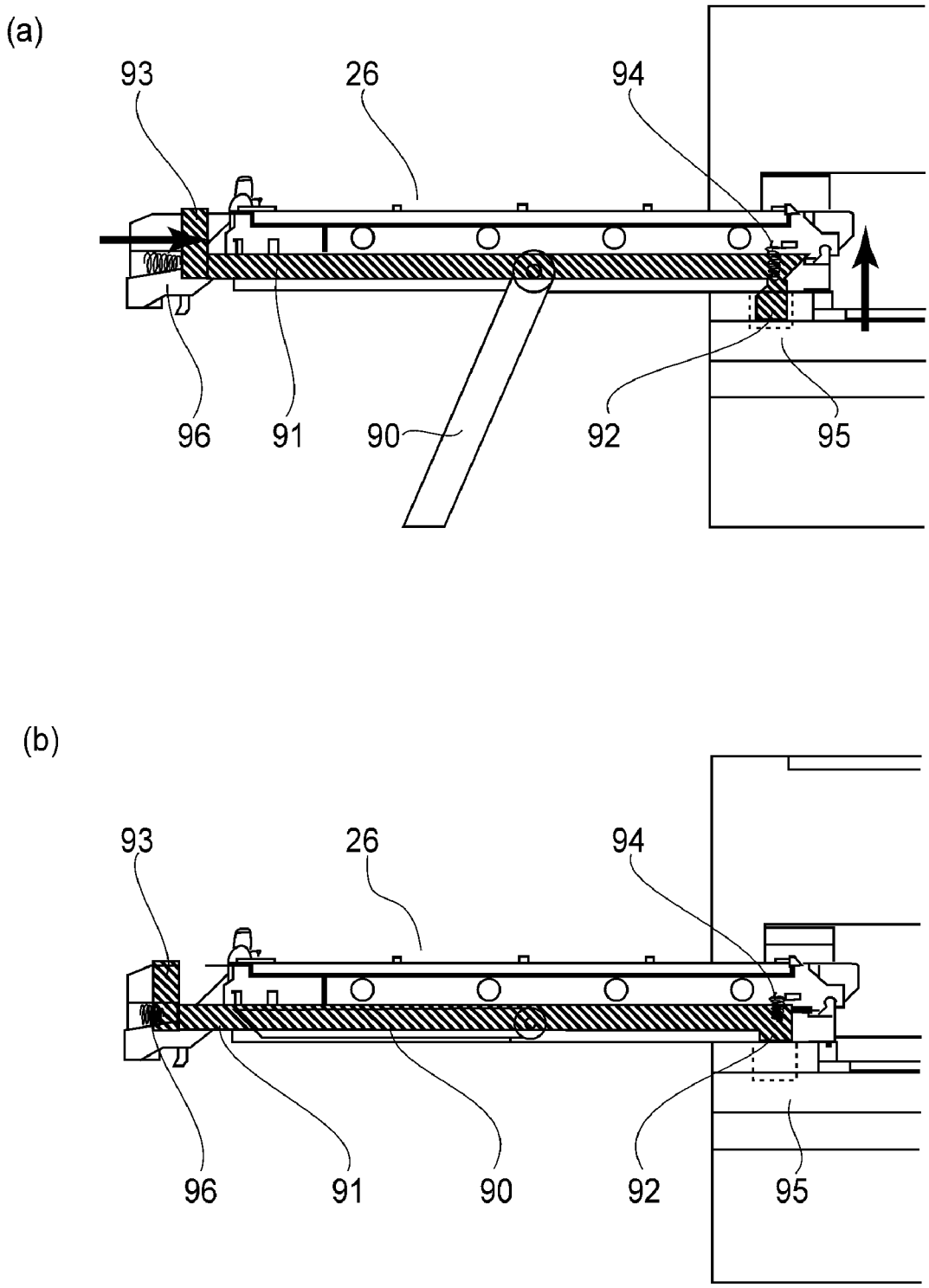
FIGS. 5(*a*) and 5(*b*) are sectional views of the cartridge tray in the first preferred embodiment of the present invention, which are for describing the method for supporting the cartridge tray after the cartridge tray is rotationally moved into the displacement position.

Referring also to FIG. 5(*b*), the cartridge tray 26 is provided with a tray supporting member 90, which supports the cartridge tray 26 when the cartridge tray 26 is in its displacement position. The tray supporting member 90 is a part of the cartridge tray 26. When the cartridge tray 26 is in the outward position O, it remains retracted. It is movable into the position, shown in FIG. 5(*a*), when the cartridge tray 26 is out of the area in which it faces the opening B. As the tray supporting member 90 is moved into the position shown in FIG. 5(*b*), the cartridge tray 26 is prevented from tilting downward, by the surface on which the electrostatic image forming apparatus is sitting.

Moving the cartridge tray 26 into its displacement position (shown in FIG. 4(*b*)), which is away from the area in which the cartridge tray 26 squarely faces the opening B, makes it possible to carry out such operations as taking care of the paper jam or the like in the main assembly A through the opening B.

Next, referring to FIGS. 5(*a*) and 5(*b*), the locking means for temporarily locking the cartridge tray 26 in the abovementioned displacement position will be described.

FIG. 5(*a*) is a sectional view of the cartridge tray 26 which is remaining temporarily locked in the displacement position by the tray locking member 92 after being rotationally moved into the displacement position.

Referring to FIG. 5(*a*), the cartridge tray 26 has the tray locking member 92 described above, and a tray handle 93 which is used for the operation for rotational moving the cartridge tray 26. It is also provided with a connective member 91, the movement of which causes the tray locking member 92 and handle 93 to move together. As for the main assembly A, it has a tray locking member engaging portion 95, which is positioned so that as the cartridge tray 26 is moved into the displacement position, it engages with the tray locking member 92.

Referring also to FIG. 5(*a*), the cartridge tray 26 is provided with a tray lock spring 94, which keeps the tray locking member 92 pressured upward of the main assembly A (direction indicated by arrow mark in FIG. 5(*a*)). Further, the cartridge tray 26 is provided with a handle spring 96, which keeps the tray handle 93 pressured rightward (direction indicated by arrow mark in FIG. 5(*a*)).

Referring also to FIG. 5(*a*), in order to ensure that when the tray handle 93 is not operated, that is, when the tray handle 93 is not moved leftward in FIG. 5(*a*), the tray locking member 92 remains in its bottom position, the handle spring 96 is made greater in resiliency than the tray lock spring 94. Therefore, as the tray handle 93 is released, the connective member 91 is moved rightward in FIG. 5(*a*), whereby the tray locking member 92 is moved downward by the connective member 91. Thus, as the cartridge tray 26 is rotationally moved into the displacement position, the cartridge tray 26 becomes temporarily locked in the displacement position.

FIG. 5(*b*) is a side view of the portions of the cartridge tray 26, which are essential to the present invention, after the operation of the tray handle 93, that is, after the completion of the leftward movement (in FIG. 5(*b*)) of the tray handle 93.

Referring to FIG. 5(*b*), after the completion of the leftward movement of the tray handle 93, the connective member 91 is movable in the leftward in FIG. 5(*b*). As the linking member 91 is moved leftward, the tray locking member 92 is allowed to be moved upward of the main assembly A by the resiliency of the tray locking spring 94. As a result, the cartridge tray 26 becomes unlocked.

If it is wanted to return the cartridge tray 26 from the displacement position T to the outward position O, the cartridge tray 26 is to be rotated about the rotational shaft 74 in the direction opposite from the abovementioned direction. As the cartridge tray 26 is rotated in the opposite direction, the cartridge tray 26 moves back into the outward position O, from which the cartridge tray 26 can be moved back into its preset position I (image forming position) in the main assembly A, and the stopper boss 85 of the cartridge tray 26 engages with the stopper claw 84 of the main assembly A.

When the cartridge tray 26 is rotationally moved back into the outward position O, the tray handle 93 is moved in the direction indicated by the arrow mark in FIG. 5(*a*). Therefore, the tray locking member 92 moves upward relative to the main assembly A, making it possible for the cartridge tray 26 to be rotationally moved. Further, also when the cartridge tray 26 is moved back from the outward position O into the inward position I (image forming position) in the main assembly A, the tray handle 93 is moved in the direction (leftward) indicated by the arrow mark in FIG. 5(*a*)). Therefore, the tray locking member 92 is allowed to move upward. Therefore, it does not occur that the tray locking member 92 hinders the movement of the cartridge tray 26.

Referring to FIG. 5(*b*), the tray supporting member 90 can be folded back to one of the lateral walls of the cartridge tray 26 so that it becomes roughly parallel to the lateral wall. Thus, as the cartridge tray 26 is moved back into its inward position I (image forming position) in the main assembly A from the outward position O, the tray supporting member 90 is stored in the tray supporting member 27.

As described above, in this embodiment of the present invention, after the cartridge tray 26 is moved from its inward position I to its outward position O, it can be rotationally moved about the rotational shaft 74, while remaining supported by the main assembly A, so that it can be displaced away from the area in which it squarely faces the opening B. Therefore, the operational space for taking care of paper jam or the like in the main assembly A can be created without disengaging the cartridge tray 26 from the main assembly A. That is, this embodiment of the present invention can improve an electrophotographic image forming apparatus in usability.

Embodiment 2

Next, referring to FIGS. 8-10, the second preferred embodiment of an image forming apparatus in accordance with the present invention will be described. This embodiment of image forming apparatus is structured so that after the cartridge tray 26 is pulled out of its inward position I (preset inward position) in the main assembly A and moved into its outward position O, it can be vertically moved upwardly out of the area (outward position O), in which it squarely faces the aforementioned opening B, while remaining horizontal. Hereafter, the method for moving the cartridge tray 26 in this embodiment will be described.

Figure 8:
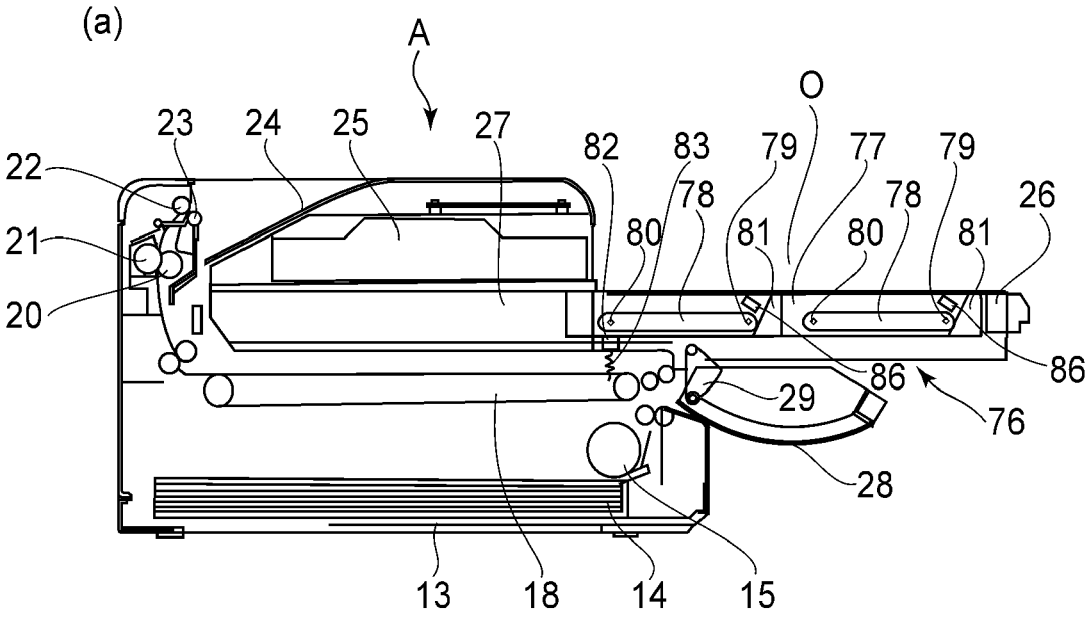
FIG. 8(*a*) is a sectional view of the image forming apparatus in the second preferred embodiment of the present invention, and FIG. 8(*b*) is a sectional view of the essential portions of the image forming apparatus, which is for describing the method for moving the cartridge tray.
Figure 8:
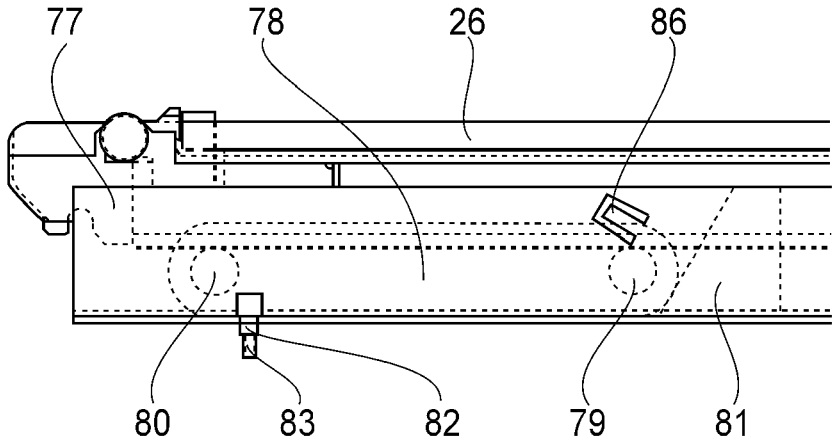

FIG. 8(*a*) is a sectional view of the image forming apparatus when the cartridge tray 26 of the apparatus is in its outward position O. The image forming apparatus in this embodiment also has a tray guiding member 76 shown in FIG. 8(*a*), which is a means for displacing the cartridge tray 26 into a displacement position T (FIG. 10) from the area in which the cartridge tray 26 squarely faces the opening B of the main assembly A, after the cartridge tray 26 is moved into its outward position O (FIG. 8(*a*)), as does the counterpart the first preferred embodiment.

The tray guiding member 76 is a member for displacing the cartridge tray 26 straight upward or downward of the above-mentioned opening B, from the area in which it squarely faces the opening B, after the cartridge tray 26 is moved into its preset outward position O. Incidentally, the image forming apparatus in this embodiment is an example of an image forming apparatus, which is structured so that the cartridge tray 26 is displaced in the upward direction of the opening B.

Next, referring to FIG. 8(*a*), the tray guiding member 76 has a pair of auxiliary rails 77, and rail linkages 78. The auxiliary rails 77 are the rails for supporting the cartridge tray 26 in such a manner that the cartridge tray 26 can be moved from the inward position I in the main assembly A to the outward position O. The tray linkages 78 are linkages for upwardly displacing the cartridge tray 26 from the auxiliary rails 77, that is, from the area in which the cartridge tray 26 squarely faces the opening B.

Referring to FIG. 8(*a*), as the cartridge tray 26 is pulled out of the main assembly A, the auxiliary rails 77 and tray linkages 78 are pulled out of the main assembly A along with the cartridge tray 26. There are a total of four tray linkages 78. More specifically, the two tray linkages 78 are on the side from which the process cartridges on the cartridge tray 26 are not driven, and are connected to one of the auxiliary rails 77, whereas the other two tray linkage 78 are on the side from which the process cartridges on the cartridge tray 26 are driven, and are connected to the other auxiliary rail 77. Each auxiliary rail 77 and corresponding tray linkages 78 are connected to each other with auxiliary rail bosses 79. The cartridge tray 26 and each tray linkage 78 are connected to each other with a tray boss 80. Further, the auxiliary rails 77 are attached to the main assembly A so that they cannot be pulled out the main assembly A beyond the auxiliary rail position shown in FIG. 8(*a*).

Next, referring to FIG. 8(*b*), the main assembly A is provided with a pair of locking members 82 for locking the auxiliary rails 77 in the outward positions for the auxiliary rails 77 after the auxiliary rails 77 are pulled out of the main assembly A along with the cartridge tray 26. Each locking member 82 is positioned so that before the cartridge tray 26 is moved upward, the position of the locking member 82 coincides with that of the inward end of the inward tray linkage 78. Further, each locking member 82 is kept pressured upward by a locking spring 83. When the auxiliary rails 77 and cartridge tray 26 are in their outermost positions, the tray linkages 78 and the weight of the cartridge tray 26 itself prevents the locking member 82 from being made to protrude upward by the locking spring 83. FIG. 8(*b*) shows in detail how the locking member 82 is being prevented from protruding.

If it is necessary to move the cartridge tray 26 from its outward position O to the displacement position T, which is on the upward side of the opening B, all that is necessary is to pull the cartridge tray 26 in the same direction as the direction in which the cartridge tray 26 is to be pulled to be moved out of the main assembly A and placed in the outward position O. As the cartridge tray 26 is pulled as described above, it moves into the above described displacement position T. More specifically, referring to FIG. 9(*a*), as the cartridge tray 26 is pulled as described above, the tray linkages 78 rotate in the clockwise direction about the auxiliary rail bosses 79. The movement of the cartridge tray 26 is regulated by the contact between a linkage guide 81 (regulating means), with which each auxiliary rail 77 is provided, and the corresponding tray linkage 78. Further, while the tray linkages 78 are in contact with the linkage guides 81, the cartridge tray 26 remains temporarily locked in the displacement position T by a linkage claw 86 (engaging means), being prevented from returning to the outward position O.

Figure 9:
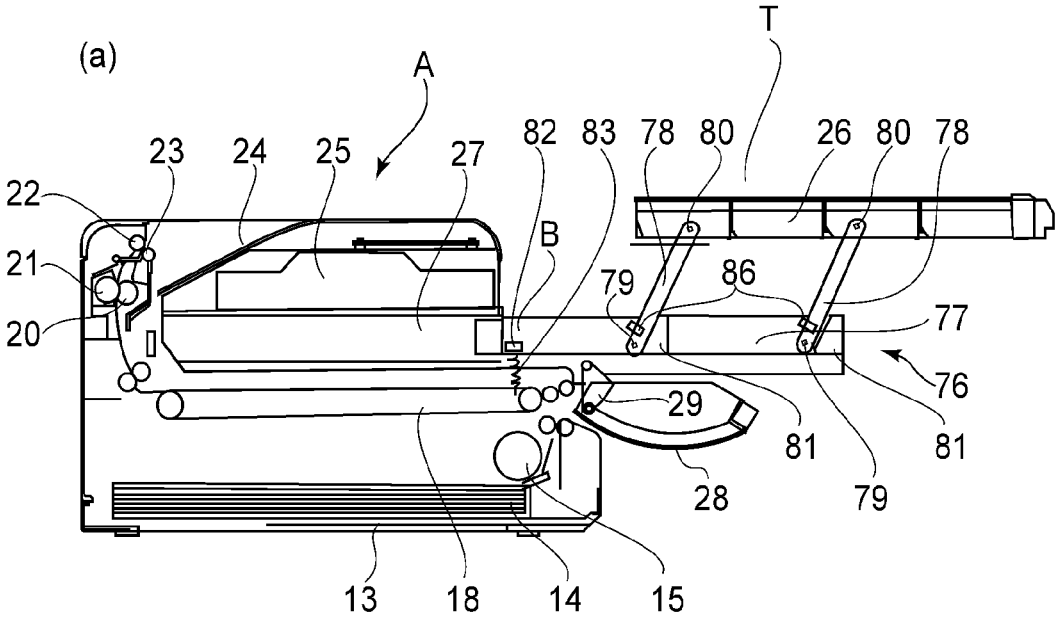
FIG. 9(*a*) is a sectional view of the image forming apparatus in the second preferred embodiment of the present invention, and FIG. 9(*b*) is a sectional view of the essential portions of the image forming apparatus, which is for describing the method for moving the cartridge tray.
Figure 9:
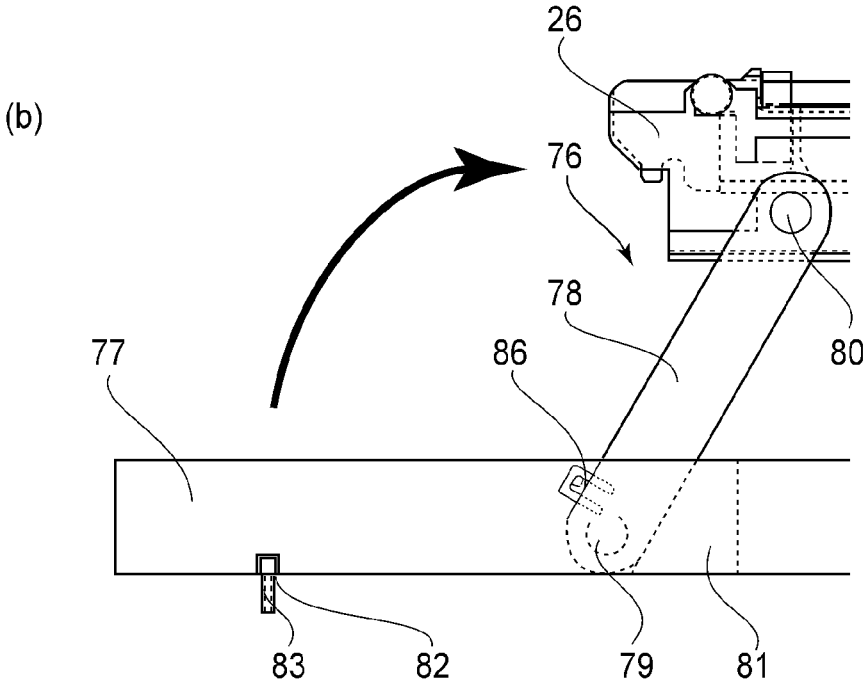

Next, referring to FIG. 9(*b*), as the cartridge tray 26 is moved into the displacement position T, the locking members 82 are allowed to be made to upwardly protrude by the locking springs 83, and engage with the auxiliary rails 77. Therefore, the auxiliary rails 77 are prevented from moving back into the main assembly A. FIG. 9(*b*) shows in detail the portions of the image forming apparatus, which are related to the control of the auxiliary rails 77 by the locking members 82.

Figure 10:
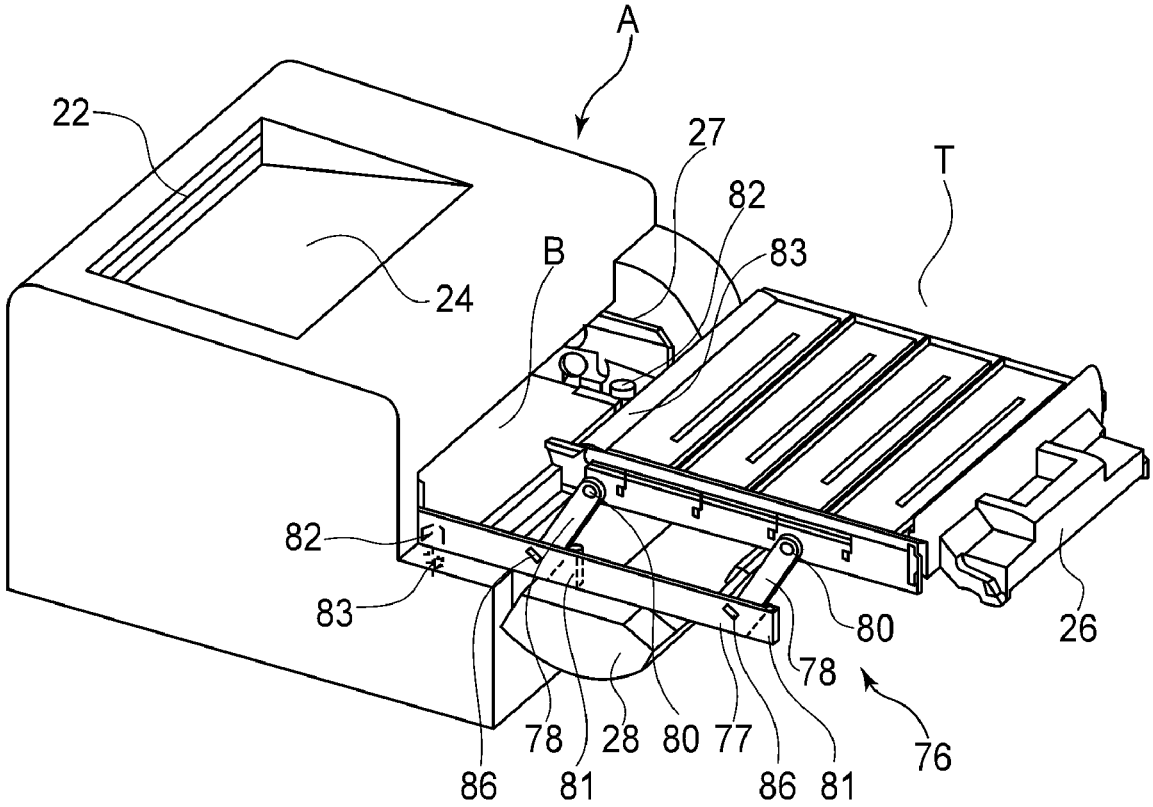
FIG. 10 is a perspective view of the main assembly and cartridge tray of the image forming apparatus in the second preferred embodiment of the present invention, which is for describing the method for moving the cartridge tray.

FIG. 10 is a perspective view of the image forming apparatus when the cartridge tray 26 of the apparatus is in its displacement position T, into which it was displaced after being pulled out to its outward position O. Upwardly displacing the cartridge tray 26 from the area in which the cartridge tray 26 squarely faces the opening B makes it possible to carry out such an operation as taking care of paper jam or the like through the opening B without disengaging the cartridge tray 26 from the main assembly A.

Further, the portion of the linkage claw 86, which actually locks the tray linkage 78, is slanted. Therefore, the tray linkages 78 can be unlock by pushing the cartridge tray 26 toward the main assembly A with a proper amount of force. In other words, when the cartridge tray 26 is in the abovementioned displacement position T, it can be returned to the outward position O by pushing the cartridge tray 26 toward the main assembly A with a reasonable amount of force.

As described above, in this embodiment, the cartridge tray 26 is attached to the auxiliary rails 77 with the tray linkages 78. When it is necessary to carry out such an operation as taking care of the paper jam or the like, the cartridge tray 26 is upwardly moved away, while being kept parallel to the main assembly A by the tray linkages 78, from the area in which it squarely faces the opening B, after it is moved from the inward position I in the main assembly A to the outward position O. Therefore, the operational space for taking care of the paper jam or the like in the main assembly A can be created without removing the cartridge tray 26 from the main assembly A. In other words, this embodiment also can improve an electrophotographic image forming apparatus in usability.

Miscellaneous Embodiments

In the first preferred embodiment, the image forming apparatus was structured to support the cartridge tray so that the cartridge tray can be moved out of the area, in which it squarely faces the opening B, in the leftward direction after being moved from the inward position I to the outward position O. This embodiment, however, is not intended to limit the present invention in terms of the direction in which the cartridge tray is to be moved out of the area in which it squarely faces the opening B. That is, even if an image forming apparatus is structured so that the cartridge tray can be moved out of the area, in which it squarely faces the opening B, in the rightward direction, after being pulled out of the main assembly A, the same effects as those described above can be achieved.

Also in the first preferred embodiment, the image forming apparatus was structured so that the cartridge tray is provided with the rotational shaft, about which the cartridge tray can be rotationally moved, and the means for displacing the cartridge tray away from the area in which the cartridge tray squarely faces the opening B, after the cartridge tray is moved from the inward position to the outward position, whereas the main assembly is provided with the tray locking member engaging portion. However, this embodiment of the present invention is not intended to limit the present invention in scope. That is, an electrophotographic image forming apparatus may be structured so that the main assembly is provided the means for displacing the cartridge tray away from the abovementioned area, and the cartridge tray is provided with the tray locking member engaging portion. Such a structural arrangement can also provide the same effects as those achieved by the first preferred embodiment.

Further, in the second preferred embodiment described above, the image forming apparatus was structured so that the cartridge tray was supported to allow the cartridge tray to be upwardly displaced after being moved from the inward position to the outward position. This embodiment, however, is not intended to limit the present invention is scope. That is, an electrostatic image forming apparatus may be structured so that the cartridge tray can be downwardly displaced from the area in which it squarely faces the opening B, after being pulled out of the main assembly A and moved into the outward position. Such a structural arrangement also can provide the same effects as those described above.

Further, in the preceding preferred embodiments described above, the process cartridges were removably mountable in the main assembly of the image forming apparatus. The preceding embodiments, however, are not intended to limit the present invention in scope. That is, the present invention is also applicable to electrophotographic image forming apparatuses structured so that process cartridges are removably mountable in the cartridge supporting member which is movably supported by the main assembly. Further, the process cartridges in the preceding embodiments were such process cartridges that have a photosensitive drum, a development roller, etc. However, the preceding embodiments are not intended to limit the present invention in terms of the process cartridge design. That is, the present invention is applicable to any process cartridge which integrally comprises an electrophotographic photosensitive drum, and one or more processing means which process the electrophotographic photosensitive drum, and which are removably mountable in the main assembly of an electrophotographic image forming apparatus. More concretely, all that is necessary for the present invention to be applicable to a given process cartridge is that the process cartridge is made up of an electrophotographic photosensitive drum, at least one among the abovementioned processing means, that is, the developing means, charging means, and cleaning means, and a cartridge (shell) in which the photosensitive drum and processing means are integrally placed.

Further, in the preceding embodiments, the image forming apparatuses used four removably mountable process cartridges. However, the preceding embodiments are not intended to limit an image forming apparatus in the number of process cartridges. That is, the present invention is applicable regardless of the process cartridge count.

Further, in the preceding embodiments of the present invention, the image forming apparatuses were printers. However, the preceding embodiments are not intended to limit the present invention in terms of image forming apparatus type. That is, not only is the present invention applicable to various printers, but also, image forming apparatuses other than printers, that is, copying machines, facsimile apparatuses, multi-functional image forming apparatuses capable of performing two or more functions of the preceding apparatuses. Further, the image forming apparatuses in the preceding preferred embodiments were those which uses a transfer belt as their recording medium, and which sequentially transfer in layers toner images, different in color, onto the transfer belt. However, the preceding embodiments are not intended to limit the application of the present invention to those in the preceding embodiments. That is, the present invention is also applicable to image forming apparatuses which use an intermediary transfer member, transfer toner images, different in color, onto the intermediary transfer member, and transfer all at once the toner images from the intermediary transfer member, onto final recording medium. The effects similar to those described above can be achieved by the application of the present invention to the cartridge supporting member of any of these image forming apparatuses. Further, the recording medium may be OHP sheets, labels, etc., in addition to sheets of recording paper.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 249590/2008 and 191927/2009 filed Sep. 29, 2008 and Aug. 21, 2009, respectively, which are hereby incorporated by reference.

What is claimed is:

1. An electrophotographic image forming apparatus for forming an image on a recording material in the state that a cartridge is detachably mounted to a main assembly of said electrophotographic image forming apparatus, said electrophotographic image forming apparatus comprising:

an opening provided in said main assembly;

a cartridge supporting member linearly movable through said opening between (i) an inside position, in said main assembly of the apparatus, for forming an image using said cartridge and (ii) an outside position that is outside said main assembly of the apparatus;

retracting means for retracting said cartridge supporting member from the outside position to a retracted position for opening said opening such that an operation in said main assembly of the apparatus is capable through said opening; and locking means for locking said cartridge supporting member, retracted to the retracted position by said retracting means relative to said main assembly of the apparatus, at the retracted position.

2. An apparatus according to claim 1, wherein said cartridge supporting member is movable from the outside position through said opening in a linear moving direction, and the retracted position is on one side on a horizontal direction crossing with the moving direction, and wherein, said cartridge supporting member is capable of retracting said cartridge supporting member while maintaining a horizontal state of said cartridge.

3. An apparatus according to claim 2, wherein said retracting means includes a shaft about an axis of which said cartridge supporting member is rotatable and which is provided on said cartridge supporting member, and an engaging portion, provided in said main assembly of the apparatus, engageable with said shaft, and wherein, when said cartridge is moved from the inside position to the outside position, said shaft is engaged with said engaging portion by which said cartridge supporting member is rotatably supported by said main assembly of the apparatus.

4. An apparatus according to claim 2, wherein said retracting means includes a shaft about an axis of which said cartridge supporting member is rotatable and which is provided in said main assembly of the apparatus, and an engaging portion, provided on said cartridge supporting member, engageable with said shaft, and wherein, when said cartridge is moved from the inside position to the outside position, said shaft is engaged with said engaging portion by which said cartridge supporting member is rotatably supported by said main assembly of the apparatus.

5. An apparatus according to claim 1, wherein the retracted position is on one side in a vertical direction, and said retracting means is capable of retracting said cartridge supporting member while maintaining a horizontal state of said cartridge supporting member.

6. An apparatus according to claim 5, further comprising regulating means for limiting downward inclination of said cartridge supporting member retracted to the retracted by said retracting means.

7. An apparatus according to claim 6, wherein said main assembly of the apparatus includes an openable member for openably closing said opening, said openable member being effective to limit the downward inclination of said cartridge supporting member retracted to the retracted position, wherein said openable member has a function of said regulating means.

8. An apparatus according to claim 5, wherein said retracting means includes a rail member supporting said cartridge supporting member movably from the inside position to the upper position, and a link for retracting said cartridge supporting member in a vertical direction from the outside position.

9. An apparatus according to claim 8, wherein said cartridge is a process cartridge including an electrophotographic photosensitive drum and process means actable on said electrophotographic photosensitive drum.

10. An apparatus according to claim 9, wherein a cartridge supporting member supports, in a juxtaposed manner, said process cartridge containing a yellow color developer, a process cartridge containing a magenta color developer, a process cartridge containing a cyan color developer, a process cartridge containing a black color developer, and wherein said electrophotographic image forming apparatus is capable of forming a color image on the recording material.

11. An apparatus according to claim 10, wherein said cartridge supporting member is movable in a direction perpendicular to a longitudinal direction zone said process cartridge is in between the inside position and the outside position.

* * * * *